US011336068B2

(12) United States Patent
Fischer et al.

(10) Patent No.: US 11,336,068 B2
(45) Date of Patent: May 17, 2022

(54) CRIMPING DIE DEVICE, CRIMPING PRESS AND METHOD FOR CREATING A CRIMP CONNECTION

(71) Applicant: SCHLEUNIGER AG, Thun (CH)

(72) Inventors: Wolfgang Fischer, Zug (CH); Carmelo Messina, Rotkreuz (CH); Marco Häfner, Baar (CH)

(73) Assignee: Schleuniger AG, Thun (CH)

( * ) Notice: Subject to any disclaimer, the term of this patent is extended or adjusted under 35 U.S.C. 154(b) by 0 days.

(21) Appl. No.: 17/064,752

(22) Filed: Oct. 7, 2020

(65) Prior Publication Data

US 2021/0104857 A1 Apr. 8, 2021

(30) Foreign Application Priority Data

Oct. 8, 2019 (EP) ..... 19202006

(51) Int. Cl.
*H01R 43/00* (2006.01)
*H01R 43/048* (2006.01)

(52) U.S. Cl.
CPC ..... *H01R 43/048* (2013.01); *Y10T 29/53213* (2015.01)

(58) Field of Classification Search
CPC ..... Y10T 29/53235; Y10T 29/53213; Y10T 29/49181; Y10T 29/49185; Y10T 29/5193; Y10T 29/53226; Y10T 29/49204; Y10T 29/49218; Y10T 29/53522; H01R 43/048; H01R 12/68; H01R 43/058
USPC ..... 29/748.33 M, 747, 753, 761, 861, 863
See application file for complete search history.

(56) References Cited

U.S. PATENT DOCUMENTS 4,753,382 A * 6/1988 Bajpai ..... H05K 13/046 227/109
8,739,395 B2 6/2014 Chikyu
2020/0067252 A1* 2/2020 Frey ..... H01R 11/12

FOREIGN PATENT DOCUMENTS

DE 10 2008 003 961 A1 7/2008

* cited by examiner

*Primary Examiner* — Thiem D Phan
(74) *Attorney, Agent, or Firm* — Finch & Maloney PLLC; Michael J. Bujold; Jay S. Franklin

(57) ABSTRACT

A crimping die device (15) for a crimping press which includes a first movable pressing die (20), which is preferably essentially vertically movable, a first drive device (22), and the first drive device (22) comprises a first drive (23) as well as a base structure (17). Furthermore, a wedge flange (30) is present, which is movable and is connected to the first drive (23) of the first drive device (22). The invention furthermore relates to a crimping press with a crimping die device as well as a method for making a crimp connection with a crimping die device in a crimping press.

17 Claims, 4 Drawing Sheets

CRIMPING DIE DEVICE, CRIMPING PRESS AND METHOD FOR CREATING A CRIMP CONNECTION

This application claims priority from European patent application serial no. 19202006.3 filed Oct. 8, 2019.

FIELD OF THE INVENTION

The invention relates to a crimping die, a crimping press and a method for creating a crimp connection.

BACKGROUND OF THE INVENTION

In order to create a crimp connection in a crimping press, typically, at least two crimping tools are used that are arranged in the crimping press. The two crimping tools are arranged oppositely on a vertically moveable pressing die and on a further pressing die, which is generally static and is also referred to as an anvil. The region between the two crimping tools is typically called the crimping region. Typically, crimping presses are designed as knee-lever crimping presses with a vertically moveable anvil.

A crimp connection usually comprises a single-core or multi-core cable and a connecting element, such as a plug, an eyelet or a socket for example. During a crimping process, the cable is arranged on the connecting element at least in sections and is connected to the connecting element by means of plastic deformation of a section of the connecting element.

DE 28 20 690 A1 discloses a crimping press for creating a crimp connection to a rack, which is arranged on a base plate. The crimping press has a moveable stamping unit with a crimping tool and a moveable anvil. The moveable anvil is horizontally moveable using an anvil shift mechanism and coupled to the moveable stamping unit. A crimping press similar to this type is also disclosed in U.S. Pat. No. 4,682,400 A.

The disadvantage of these known solutions is that an anvil that can be moved horizontally to the crimping tool does not keep the horizontal position or the vertical position stable, thereby making it impossible to create a crimp connection with a high and reproducible level of precision. In the case of the horizontally moving anvil, guiding the contacts or the connecting elements is also more difficult.

SUMMARY OF THE INVENTION

It is the object of the present invention to remedy one or a plurality of disadvantages of prior art. In particular, the task is to create a crimping die device for a crimping press, which is space-saving and stable and can be easily arranged in a crimping press. Furthermore, the object of the invention is to create a crimping press that creates a crimp connection with a high level of precision, as well as to provide a method for reproducibly creating such a precise crimp connection.

At least some of the above tasks are achieved by means of the features of the independent claims. Favourable further embodiments are shown in the figures and in the dependent patent claims.

The crimping die device according to the invention for a crimping press comprises an anvil, which is designed as a first moveable pressing die and a first drive device, wherein the drive device comprises a first drive, as well as a base structure. Furthermore, a wedge flange is present, which is moveable and is connected to the first drive of the first drive device, wherein the wedge flange can be positioned between the first moveable pressing die and the base structure.

The first moveable pressing die, which is typically also referred to as anvil, can be transferred from a resting position into a crimping position. In the crimping position, the first moveable pressing die is designed in such a way that it can create a crimp connection in conjunction with a crimping tool. The first moveable pressing die is held in a stable and stiff manner by the wedge flange positioned between the base structure and the first moveable pressing die so that a plurality of crimp connections can be reproducible with the aid of the crimping die device and can be produced with high precision across recurring manufacturing cycles. This crimping die device can be arranged on a crimping press in a simple and stable manner and can also be arranged as an upgrade kit to an existing crimping press. The wedge flange can be transferred from a working position into a resting position by means of the drive device, wherein the wedge flange in the working position is operatively connected to the first moveable pressing die and thus supports the first moveable pressing die in a stable manner while this is preferably in the crimping position. In the resting position, the wedge flange is separated from the first moveable pressing die and spaced away, which allows it to move freely between crimping and resting position in particular.

Preferably, the first moveable pressing die can be moved vertically, and the wedge flange, in particular, can essentially be moved in a normal manner towards the first moveable pressing die. Typically, a crimping tool is arranged on the first moveable pressing die, wherein the crimping tool defines the crimping region of the crimping die device at least in sections. The vertical movement of the first moveable pressing die enlarges the crimping region in the present crimping die device so that a simplified arrangement of the cable and the connecting element is possible. This allows the region opposite the crimping region of the first moveable pressing die to be dimensioned at a smaller size so that the entire crimping die device can be dimensioned in a space-saving manner.

Favourably, the base structure of the crimping die device is a plate-shaped or a profile-shaped connecting structure so that the overall rigidity in the crimping die device can be improved. A plate-shaped connecting structure can be produced as a compact construction and has an increased dead weight so that the crimping die device can be positioned on the substrate in a stable manner. A profile-shaped connecting structure has a high level of rigidity, wherein the dead weight of the crimping die device can be reduced.

Preferably, the first drive device is a pneumatic drive device, which is designed to move the wedge flange between its working position and its resting position. For example, the pneumatic drive device comprises a double-acting guide cylinder, using which the wedge flange can be continuously moved between its working position and its resting position, and the positions in and between the working position and the resting position are precisely adjustable. For example, the double-acting guide cylinder comprises an integrated linear guide and comprises an air chamber and a piston rod as a first drive for linear movement or for transferring the wedge flange so that the positions of the wedge flange in and between the working position and the resting position are continuously adjustable.

Alternatively, the first drive device is a linear drive, which is designed to move the wedge flange between its working position and its resting position. For example, the linear drive comprises a threaded spindle and a threaded nut, which are operatively connected to the wedge flange. The threaded spindle is driven by the first drive so that the wedge flange can be linearly moved between its working position and its resting position, and the positions in and between the working position and the resting position are precisely adjustable.

Preferably, the first moveable pressing die is connected to the first drive of the first drive device. This also makes the first moveable pressing die with the first drive of the first drive device moveable in addition to the wedge flange. Thereby both movements can be executed simultaneously so that an efficient and cost-effective drive device can be provided.

Favourably, the first drive of the first drive device is designed to transfer the first moveable pressing die from the resting position into the crimping position and to simultaneously transfer the wedge flange from the resting position into the working position. Thus, not only the positions of the wedge flange in and between the working position and the resting position are adjustable, but simultaneously, the positions of the first moveable pressing die in and between the resting position and the crimping position are also precisely adjustable.

In particular, the first moveable pressing die is connected to the wedge flange by means of a gear unit. This means that the first moveable pressing die is spaced away by the wedge flange and can be moved with the aid of the gear unit. The gear unit is designed to transfer a movement and/or force from the wedge flange onto the first moveable pressing die so that an efficient movement of the first moveable pressing die is possible using the wedge flange.

Favourably, the gear unit comprises at least one connection beam. This makes it easy to transfer the moving force to the first moveable pressing die. In particular, the gear unit comprises at least one further connection beam, whereby a symmetrical transfer of the moving force to the first moveable pressing die is possible.

Favourably, the gear unit has a contact geometry, which can be operatively connected, for example, to a sliding block guide of the wedge flange. For example, the contact geometry is connected to the connection beam and, in particular, is designed as a plain bearing, which can engage into the sliding block guide so that moving forces can be transferred from the sliding block guide onto the gear unit. This minimizes friction losses altogether when moving the contact geometry in the sliding block guide.

Alternatively, the contact geometry is designed as a simple sliding body or as a ball bearing or as a linear bearing. These components have different characteristics, such as friction behaviour or power transmission behaviour, and can be replaced in a cost-saving manner.

Preferably, a second drive device with a second drive for moving the first moveable pressing die is present. Thus, the first moveable pressing die and the wedge flange can be moved independently of each other, whereby the operative connection between the first moveable pressing die and the wedge flange is adjustable either by means of the first drive device or the second drive device.

Preferably, the wedge flange has a guide section, wherein the guide section is arranged in a first guide device of the base structure. Thereby, the wedge flange is moveably arranged securely in position in the first guide device of the base structure when it is being transferred from the working position into the resting position. The wedge flange slides along the first guide device of the base structure and is thereby guided on it.

Favourably, the first guide device of the base structure is designed as at least one groove structure that extends along the longitudinal extension of the base structure and in which the wedge flange can be moved at least in sections in a reproducible manner when being transferred from the working position into the resting position.

Preferably, the wedge flange comprises a contact surface and a base surface, wherein, between the contact surface and the base surface, a wedge angle between 0° and 30° is present. In the working position, the contact surface of the wedge flange is operatively connected to the first moveable pressing die and supports this so that the first moveable pressing die can be positioned in its crimping position free of any movement. The base surface of the wedge flange is attached to the base structure of the crimping press device so that the wedge flange is kept stable at least in the horizontal direction. The wedge angle between the contact surface and the base surface causes an efficient adjustment of the crimping position of the first moveable pressing die in the case of a slight adjustment of the working position of the wedge flange.

In particular, the wedge angle between the contact surface and the base surface is between 1° and 10°, whereby the positioning of the first moveable pressing die can be adjusted in an improved manner and the wedge flange can be held in its position in a self-locking manner.

A self-locking retention of the position of the wedge flange can be made possible here in the present case by the wedge angle being chosen to be so flat that the friction coefficient of the contact surface between the first moveable pressing die and the wedge flange can reach a value so that a vertically acting reaction force of the first moveable pressing die can no longer be converted into a horizontal moving force, thereby causing less burden on the first drive device. The power transmission in the preferred direction—a horizontal movement of the wedge flange causes a vertical movement of the first moveable pressing die—remains largely unaffected so that it can continue to act.

Preferably, the wedge angle between the contact surface and the base surface is 5°, which enables a reliable self-locking of the wedge flange. Furthermore, the positioning of the first moveable pressing die can be adjusted surprisingly and therefore, a particularly efficient operative connection between the wedge flange and the first moveable pressing die is present.

Preferably, the wedge flange has a sliding block guide, wherein the sliding block guide has a first sliding block inclination. Thus, the gear unit can engage into the first sliding block inclination at least in sections and guide the gear unit in sections securely in position.

In particular, the sliding block guide comprises at least one locking section for locking the gear unit. This allows the gear unit to be locked in a defined position.

Preferably, the sliding block guide comprises a first sliding block inclination and at least one further sliding block inclination. A wedge flange with a sliding block guide with at least two sliding block inclinations makes a particularly efficient movement of the gear unit possible. The first sliding block inclination of the sliding block guide results in a relatively large lifting movement, a relatively small force being exerted onto the first moveable first moveable pressing die. The at least one further sliding block inclination, which is especially flatter than the first sliding block inclination, causes a great force effect on the first moveable pressing die with a slight lifting movement. Thus, the first drive device can be dimensioned compactly and cost-effectively. A flat sliding block inclination acts in a self-locking manner on the movement of the first moveable pressing die so that this cannot be transferred independently into the resting position.

Favourably, the gear unit engages into the sliding block guide at least in sections so that the first moveable pressing die can be transferred securely in position. For example, the at least one plain bearing designed as contact geometry can be guided in the sliding block guide in such a way that a connection beam can transfer the first moveable pressing die from its resting position into its crimping position in a reliable manner.

Preferably, the sliding block guide is designed to open along at least one of the two sliding block inclinations is at least in sections. A sliding block guide that opens in sections has at least a sliding block guide opening, the opening limitation of which increases along the sliding block guide. This minimizes friction losses during transfer.

Preferably, the sliding block guide along the flat sliding block inclination is at least partially opened. This relieves the gear unit of the high exertions of force during the crimping process since the reaction force of the crimping press or the first moveable pressing die is significantly borne by the contact surface of the wedge flange.

Preferably, at least one of the two sliding block inclinations is substantially parallel to the contact surface of the wedge flange at least in sections. Thus, the ratio between the movement of the first moveable pressing die and the movement of the wedge flange is dimensioned in such a way that the operative connection between the first moveable pressing die and the wedge flange can be adjusted in a particularly precise manner.

In particular, the first drive device comprises at least one locking element for moving the wedge flange. The at least one locking element allows an improved transfer of the wedge flange from its working position into its resting position since thus friction losses can be further minimized during this transfer. For example, the at least one locking element is arranged on the wedge flange so that the minimization can act directly on the wedge flange and a jerky movement of the wedge flange is further minimized.

Preferably, a second guide device is present, wherein the first moveable pressing die is moveable along the second guide device. Thereby, the first moveable pressing die can be transferred securely in position when transferring from the resting position into the crimping position. This makes a reproducible positioning of the first moveable pressing die possible.

Preferably, a pre-tensioning element for pre-tensioning the first moveable pressing die is present. The pre-tensioning element generates a restoring force from the first moveable pressing die onto the wedge flange so that the operative connection between the first moveable pressing die on the wedge flange can be produced in a vibration-free manner and thus, there is continuous contact between the contact surface of the wedge flange and the first moveable pressing die. For example, the pre-tensioning element is designed as a spring.

Favourably, a projection is arranged on the first moveable pressing die and an oblong hole is arranged on the second guide device, wherein the projection extends through the oblong hole and can be moved along the longitudinal extension of the oblong hole. This allows for a constant restoring force to be exerted onto the first moveable pressing die.

A crimping press according to the invention comprises a crimping die device as described here in the present case, wherein a further pressing die is present.

The crimping press makes it possible to create a plurality of crimp connections, which can be created across recurring manufacturing cycles in a reproducible and highly precise manner. The region between the first pressing die and the further pressing die is typically referred to as the crimping region. The first moveable pressing die is additionally spaced away in its resting position, as described above, from the further pressing die, wherein the entire crimping press can simultaneously be dimensioned in a compact manner.

Favourably, the further pressing die is arranged on the crimping press in a stationary manner. The crimping process for creating a crimp connection is carried out when the first pressing die is transferred from its resting position into its crimping position, wherein at least one of the two pressing dies comprises a crimping tool. Thereby, a crimp connection can be created in a simple and time-saving manner.

Preferably, the further pressing die is moveable. The crimping process for creating a crimp connection is carried out using a crimping tool arranged on the further pressing die. The first pressing die is arranged in its crimping position and the further pressing die can be moved towards the first moveable pressing die of the crimping die device so that the crimping region is reduced during the crimping process and a highly accurate and reproducible crimp connection can be created. In this case, the further pressing die is arranged on a crimp drive device with a crimp drive, which is designed to transfer the further pressing die from its resting position into its crimping position in a reproducible manner.

In particular, the crimp drive device comprises an eccentric unit, which is driven by the crimp drive and causes a linear movement of the further pressing die. This provides a simple, fast and space-saving drive for the further pressing die.

Preferably, the crimping press and the crimping die device have a common base structure. This further stiffens the supporting operative connection between the first pressing die and the wedge flange, thereby providing for a stable crimping press for a reproducible crimping process.

Preferably, at least one housing structure is present, on which the further pressing die is arranged, and which can be connected to the base structure. This improves the rigidity in the crimping press further. The at least one housing structure ensures a stiff connection between the crimping die device and the further pressing die.

Favourably, a further guide device is present on at least one housing structure, along which the further pressing die can be transferred from its resting position into its crimping position. Thereby, the further pressing die can be guided during the crimping process securely in position.

A method according to the invention for creating a crimp connection with a crimping press comprises the following steps:

transferring an anvil, which is designed as a first moveable pressing die, from its resting position into its crimping position;

positioning a wedge flange between a base structure and the first moveable pressing die;

crimping a crimp connection with another pressing die, wherein at least one crimping tool is arranged on one of the two pressing dies.

In the crimping position, the first moveable pressing die is designed to create a crimp connection in combination with a crimping tool on the further pressing die. The first moveable pressing die is held stable and stiff by the wedge flange positioned between the base structure and the first moveable pressing die so that a plurality of crimp connections can be created with the aid of the crimping die device and can be created with high precision across recurring manufacturing cycles.

In particular, the method is carried out using a crimping die device as described here in the present case. This crimping die device can be arranged on the crimping press in a simple and stable manner and can also be arranged as an upgrade kit to an existing crimping press.

Preferably, the wedge flange at step b) is transferred from a resting position to a working position with the aid of a first drive device. The wedge flange in the working position operatively connects to the first moveable pressing die so that the first moveable pressing die is supported in a stable manner.

Preferably, after step b), the first moveable pressing die is transferred in the direction of the resting position so that it is ensured that the first pressing die is supported by the wedge flange during crimping at step c).

Favourably, the transfer of the first moveable pressing die in the direction of the resting position is carried out by means of a second drive device so that this transfer can be carried out securely in position and in a separately controlled manner.

Preferably, the transfer of the first moveable pressing die towards the resting position is carried out using a pre-tensioning element. The pre-tensioning element causes a restoring force from the first moveable pressing die onto the wedge flange so that the operative connection between the first moveable pressing die on the wedge flange is vibration-free and thus, there is continuous contact between the contact surface of the wedge flange and the first moveable pressing die.

Preferably, the transfer of the first moveable pressing die and the positioning of the wedge flange at step a) and b) is carried out simultaneously. A gear unit is arranged between the wedge flange and the first pressing die, which transfers the force flow from the movement of the wedge flange to the first moveable pressing die so that it can be easily transferred into the crimping position.

BRIEF DESCRIPTION OF THE DRAWINGS

Further advantages, features and details of the invention arise from the following description, in which exemplary embodiments of the invention are described with reference to the drawings. Enumerations such as first, second, third or others are only used to identify the components.

The reference list is also an integral part of the disclosure like the technical content of the patent claims and figures are. The figures are comprehensively described in relation to one another. Identical reference numbers denote identical components, and reference characters having different indices indicate functionally identical or similar components.

The figures show:

Figure 1:
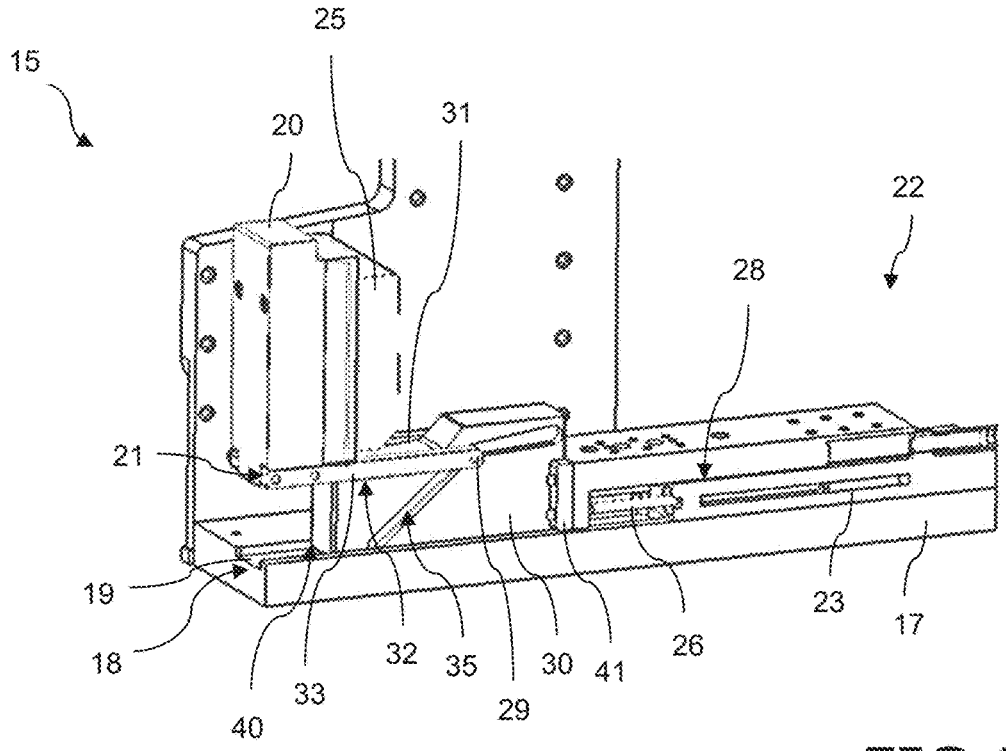
Figure 2:
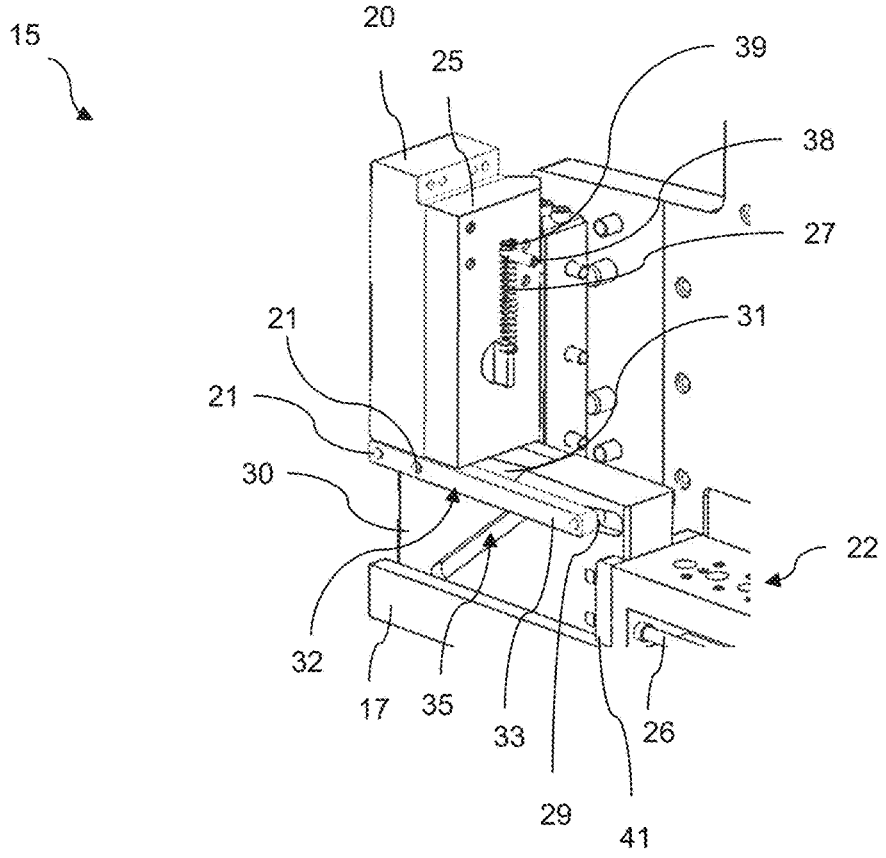
Figure 3:
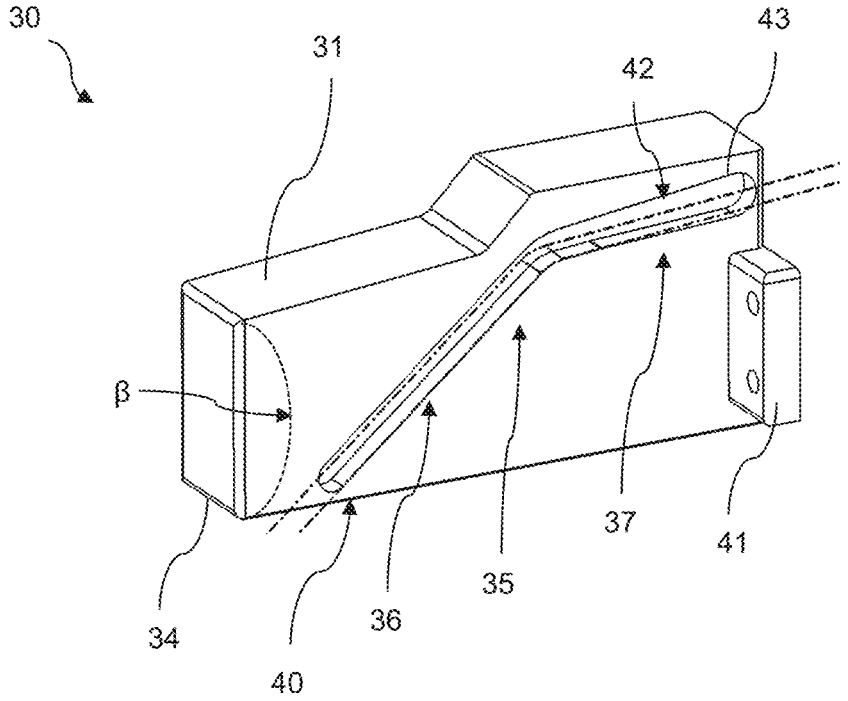
Figure 4:
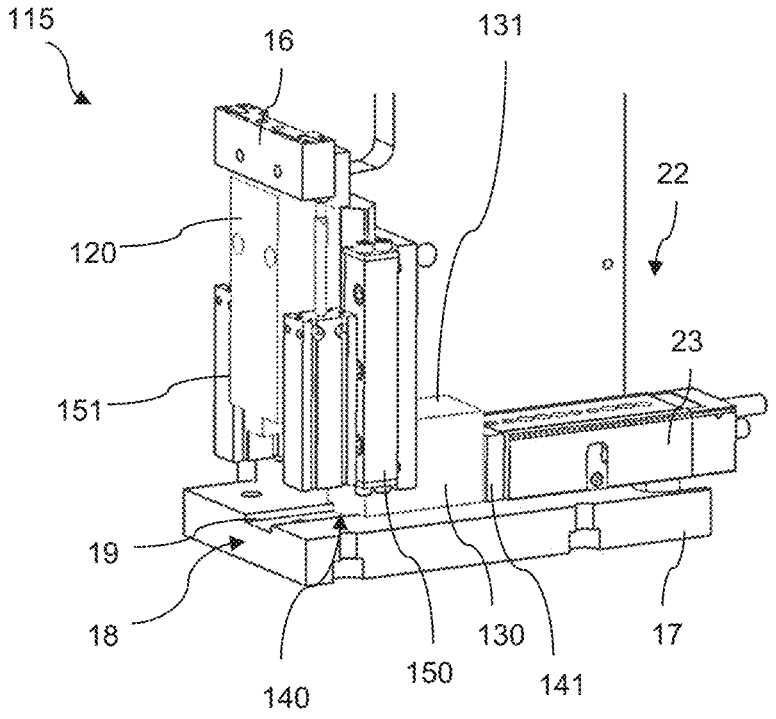
Figure 5:
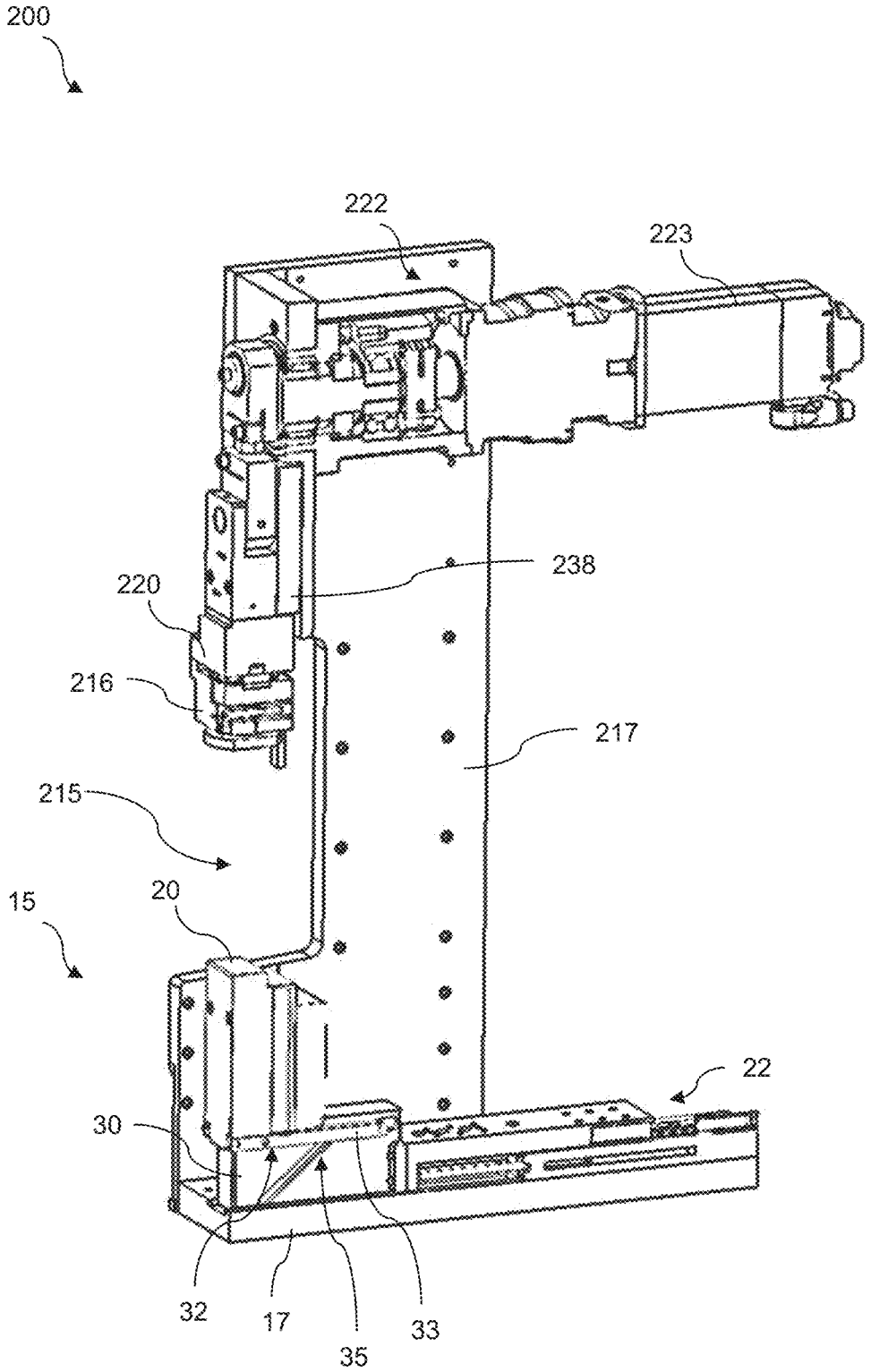
Figure 6:
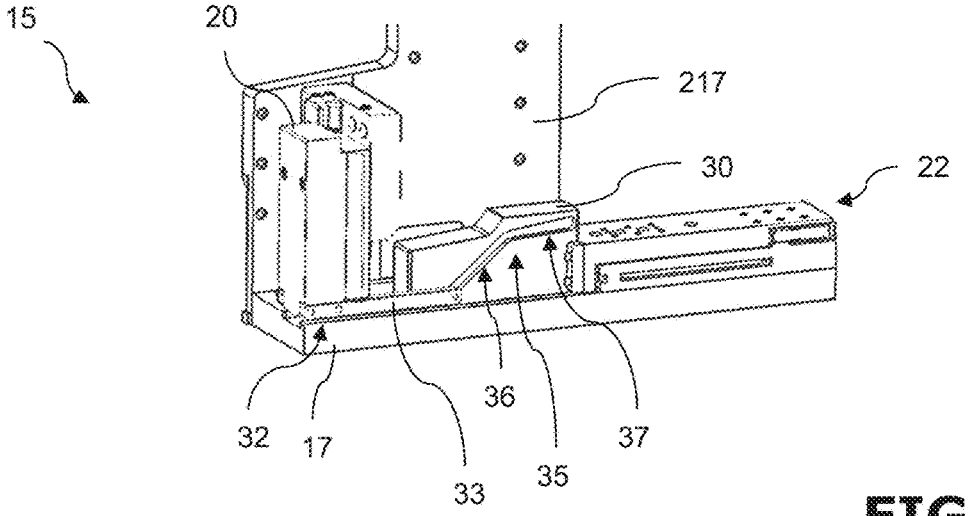
Figure 7:
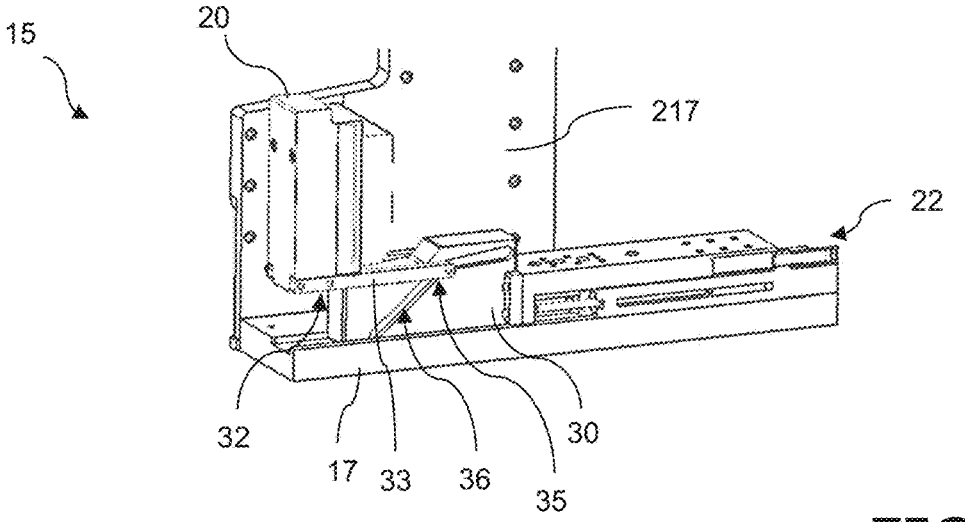
Figure 8:
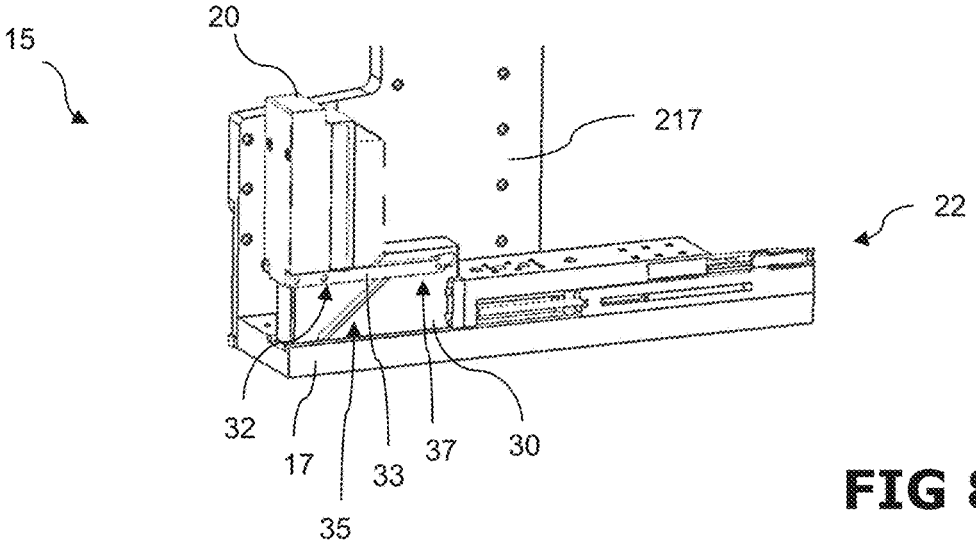

FIG. 1 a first embodiment of a crimping die device according to the invention in a first perspective illustration, FIG. 2 the crimping die device in accordance with FIG. 1 in a further perspective illustration, FIG. 3 the wedge flange of the crimping die device in accordance with FIG. 1 in a perspective illustration, FIG. 4 another embodiment of the crimping die device according to the invention in a first perspective illustration, FIG. 5 a crimping press according to the invention with a crimping die device in accordance with FIG. 1 in a perspective illustration, FIG. 6 the crimping die device in accordance with FIG. 1, wherein the wedge flange is in the resting position, in a perspective illustration, FIG. 7 the crimping die device in accordance with FIG. 6 in a further perspective illustration, and FIG. 8 the crimping die device in accordance with FIG. 6, wherein the wedge flange is in the working position, in a perspective illustration.

DETAILED DESCRIPTION OF THE PREFERRED EMBODIMENTS

FIG. 1 and FIG. 2 show a crimping die device 15 with a first moveable pressing die 20 and a first drive device 22, which are arranged on the base structure 17. The moveable pressing die 20 is arranged on a second guide device 25 in a vertically moveable manner if the crimping die device 15 is arranged on a substrate in the ready-to-use state. The drive device 22 comprises a first drive 23, which is connected to the moveable wedge flange 30. The wedge flange 30 comprises a sliding block guide 35 and can be transferred from a working position into a resting position by means of the first drive device 22, wherein the wedge flange 30 in its working position is operatively connected to the first moveable pressing die 20 and thereby supports the first moveable pressing die 20 (see FIG. 2). The first drive device 22 designed as a pneumatic drive device is designed as a double-acting guide cylinder with an integrated linear guide 28 and comprises an air chamber as the first drive 23, and a piston rod 26 for linear movement or transfer of the wedge flange 30. The base structure 17 is a connecting structure designed as a base plate and comprises a first guide device 18 designed as a groove structure 19, which extends along the base structure 17 and in which the guide section 40 of the moveable wedge flange 30 is arranged.

A projection 38 is arranged on the first moveable pressing die 20 and an oblong hole 39 is arranged on the second guide device 25. The projection 38 extends through the oblong hole 39 and can be moved along the longitudinal extension of the oblong hole 39. Furthermore, a spring-formed pre-tensioning element 27 for pre-tensioning the first moveable pressing die 20 is present, which is arranged at the second guide device 25 and is connected to the projection 38 of the first moveable pressing die 20. The pre-tensioning element 27 presses the first moveable pressing die 20 onto the wedge flange 30 so that the operative connection between the first moveable pressing die 20 and the wedge flange 30 is formed in a vibration-free manner and thus, a continuous contact exists between the contact surface 31 of the wedge flange 30 and the first moveable pressing die 20 (see FIG. 2).

The first moveable pressing die 20 is connected to a gear unit 32, which comprises a connection beam 33. The connection beam 33 is fixed to the first moveable pressing die 20 by means of the fastening means 21, which includes screws and centring sleeves here (not visible). On the connection beam 33, a plain bearing is arranged as a contact geometry 29, which engages into the sliding block guide 35 of the wedge flange 30. The gear unit 32 is designed to transfer a movement and/or a force from the moveable wedge flange 30 to the first moveable pressing die 20. The wedge flange 30 is driven by the first drive device 22 so that the first moveable pressing die 20 can be moved in one direction towards the crimping position and the wedge flange 30 can be essentially moved in a normal manner in the direction of the first moveable pressing die 20 towards the working position. The movement of the first moveable pressing die 20 towards the crimping position is the vertical direction in the ready-to-use state of the crimping die device 15. The movement of the wedge flange 30 towards the working position is the horizontal direction in the ready-to-use state of the crimping die device 15. The wedge flange 30 is positioned in its working position between the first moveable pressing die 30 and the base structure 17, wherein the first moveable pressing die 20 rests on the contact surface 31 of the wedge flange 30, thereby being in its crimping position (see FIG. 2). Thereby, not only the wedge flange 30 is moved by the first drive device 22, but also the first moveable pressing die 30 is transferred from the resting position to the crimping position.

FIG. 3 shows the wedge flange 30, which has a contact surface 31 and a base surface 34. The contact surface 31 is operatively connected to the first moveable pressing die 20 in the working position of the wedge flange 30 in order to support this, for example, in the crimping position. The base surface 34 of the wedge flange 30 is arranged in the groove structure 19 of the base structure 17 so that the wedge flange 30 is kept stable. Between the contact surface 31 and the base surface 34, there is a wedge angle β, which is 5°. The sliding block guide 35 of the wedge flange 30 comprises a first sliding block inclination 36 and a further sliding block inclination 37. Thereby, the first sliding block inclination 36 is much steeper than the further sliding block inclination 37, wherein the further sliding block inclination 37 is parallel or runs parallel to the contact surface 31 The first sliding block inclination 36 thus causes a relatively large lifting movement (in the vertical direction) for the first moveable pressing die 20, wherein a relatively small level of force is exerted onto the first moveable pressing die 20. The further sliding block inclination 37 causes a great amount of force to be exerted onto the first moveable pressing die 20 with a slight lifting movement. The sliding block guide 35 comprises a sliding block guide opening 42 with an opening limitation 43, which forms opening along the further flat sliding block inclination 37 in order to relieve the contact geometry 29 engaging into the sliding block guide 35 from the high level of force exerted during the crimp process. The wedge flange 30 comprises a connecting section 41, which is connected to the first drive 23.

FIG. 4 shows a crimping die device 115, which is essentially designed like the previously described crimping die device 15. The crimping die device 115 differs from the crimping die device 15 in accordance with FIG. 1 to FIG. 3 in that a different wedge flange 130 is present and the first moveable pressing die 120 with a second drive device 150 and a second drive 151 can be transferred from the resting position to the crimping position. This makes the first moveable pressing die 120 moveable independent of the moveable wedge flange 130. For this reason, the wedge flange 130 differs from the wedge flange 30 in accordance with FIG. 1 to FIG. 3 in that the wedge flange 130 does not comprise a sliding block guide and no gear unit is present. The wedge flange 130 comprises the contact surface 131, which supports the first moveable pressing die 120 in its crimping position. The moveable wedge flange 130 connected to the first drive device 22 is positioned in its working position between the base structure 17 and the first moveable pressing die 120. Furthermore, the wedge flange 130 comprises a guide section 140 that is designed as a projection, by means of which the moveable wedge flange 130 is moveably positioned in the groove structure 19. The wedge flange 130 comprises a connecting section 141, which is connected to the drive 23.

On the first moveable pressing die 120, a crimping tool 16 is arranged, which can also be positioned on the first moveable pressing die 20 of the crimping die device 15 in accordance with FIG. 1 and FIG. 2.

FIG. 5 shows a crimping press 200 with the crimping die device 15 in accordance with FIG. 1 and FIG. 2, as well as with a wedge flange 30 in accordance with FIG. 3. The crimping press 200 comprises a further pressing die 220, on which a crimping tool 216 is arranged. The further pressing die 220 is arranged on a crimp drive device 222 with a crimp drive 223, which is designed to transfer the further pressing die 220 from its resting position into its crimping position. Between the first moveable pressing die 20 and the further pressing die 220, the crimping region 215 extends, in which a cable and a connecting element, such as a plug, an eyelet or a socket for example, are positioned when creating a crimp connection.

The base structure of the crimping press 200 is identical to the previously described base structure 17 of the crimping die device 15. The crimping press 200 comprises a housing structure 217, which is connected to the base structure 17. The housing structure 217 comprises a further guide device 238, along which the further pressing die 220 can be transferred from its resting position in its crimping position.

On the basis of FIG. 5 to FIG. 8, a method for creating a crimp connection with a crimping die device 15 in accordance with FIG. 1 and FIG. 2, a wedge flange 30 in accordance with FIG. 3 and a crimping press 200 in accordance with FIG. 5, is described. FIG. 6 shows the crimping die device 15, wherein the wedge flange 30 is in its resting position and the first moveable pressing die 20 is in its resting position. FIG. 7 shows the crimping die device 15, wherein the wedge flange 30 is between its resting position and its working position and the first moveable pressing die 20 is between its resting position and its crimping position. FIG. 8 shows the crimping die device 15, wherein the wedge flange 30 is in its working position and the first moveable pressing die 20 is in its crimping position.

In a first step (step a)), the transfer of the first moveable pressing die 20 from its resting position into its crimping position takes place. The first moveable pressing die 20 is connected to the wedge flange 30 by the connection beam 33 with its plain bearing designed as contact geometry 29 engaging into the sliding block guide 35 and the connection beam 33 being attached to the first moveable pressing die 20 by means of the fastening means 29. The wedge flange 30 is moved with the aid of the first drive 23 and the first drive device 22 in the direction of the first moveable pressing die 20. The wedge flange 30 is pressed from its resting position along the first guide device 18 in the direction of its working position. The contact geometry 29 glides along the first sliding block inclination 36 of the sliding block guide 35, whereby the first moveable pressing die 20 is pressed with the aid of the gear unit 32 when transferring in the direction of the further pressing die 220 (see FIG. 7).

In a further step (step b)) the positioning of the wedge flange 30 between the base structure 17 and the first moveable pressing die 20 is carried out. Thereby, the wedge flange 30 is operatively connected to the first moveable pressing die 20 by the contact surface 31 supporting the first moveable pressing die 20 and raising the first moveable pressing die 20 due to the wedge angle β between the contact surface 31 and the base surface 34 of the wedge flange 30. The wedge flange 30 is transferred into the working position by means of the first drive device 22 and the first moveable pressing die is simultaneously transferred into the crimping position (see FIG. 8). The contact geometry 29, which is designed as a plain bearing, glides along the further sliding block inclination 37 of the sliding block guide 35, which is flatter than the first sliding block inclination, whereby the first moveable pressing die 20 is pressed further in the direction towards the further pressing die 220 with the aid of the gear unit 32 during transfer. Subsequently or at the same time, the first moveable pressing die 20 is transferred by means of the pre-tensioning element 27 in the direction of the resting position (see FIG. 2) so that the first moveable pressing die 20 is ultimately in the crimping position. After a cable and a connecting element designed as a socket, for example, have been positioned in the crimping region 215, then the crimping of a crimp connection takes place using a further pressing die 220, wherein at least one crimping tool 216 is arranged on one of the two pressing dies 20 and 220 (step c)). The further pressing die 220 is guided with the aid of the crimp drive 151 towards the first moveable pressing die 20 so that the crimping tool 216 can create the crimp connection.

REFERENCE LIST

15 crimping die device
16 crimping tool
17 base structure
18 first guide device
19 groove structure
20 first moveable pressing die
21 fastening means
22 first drive device
23 first drive
25 second guide device
26 piston rod
27 pre-tensioning element
28 linear guide
29 contact geometry
30 wedge flange
31 contact surface
32 gear unit
33 connection beam
34 base surface
35 sliding block guide
36 first sliding block inclination
37 further sliding block inclination
38 projection
39 oblong hole
40 guide section
41 connecting section
42 sliding block guide opening
43 opening limitation
115 crimping die device
120 first moveable pressing die
130 wedge flange
131 contact surface
140 guide section
150 second drive device
151 second drive
200 crimping press
215 crimping region
216 crimping tool
217 housing structure
220 further pressing die
222 crimp drive device
223 crimp drive
238 further guide device
β wedge angle

The invention claimed is:

1. A crimping die device (15; 115) for a crimping press comprising:

an anvil, which is designed as a first movable pressing die (20; 120), which can preferably be moved vertically, a first drive device (22) in which the first drive device comprises a first drive (23), and a base structure (17), wherein a wedge flange (30; 130) is present, which is movable and connected to the first drive (23) of the first drive device (22), and the wedge flange (30; 130) can be positioned between the first movable pressing die (20; 120) and the base structure (17).

2. The crimping die device according to claim 1, wherein the first movable pressing die (20; 120) is connected to the first drive (23) of the first drive device (22) by being connected to the wedge flange (30) by a gear unit (32), and the gear unit (32) comprises at least one connection beam (33).

3. The crimping die device according to claim 1, wherein a second drive device (150) with a second drive (151) for moving the first movable pressing die (20; 120) is present.

4. The crimping die device according to claim 1, wherein the wedge flange (30; 130) comprises a guide section (40; 140), and the guide section (40; 140) is arranged in a first guide device (18) of the base structure (17).

5. The crimping die device according to claim 1, wherein the wedge flange (30; 130) comprises a contact surface (31; 131) and a base surface (34), and a wedge angle (A) of between 0° and 30° is present between the contact surface (31, 131) and the base surface (34).

6. The crimping press according to claim 5, wherein the wedge angle (A) is between 1° and 10°.

7. The crimping press according to claim 5, wherein the wedge angle (A) is 5°.

8. The crimping die device according to claim 1, wherein the wedge flange (30; 130) comprises a sliding block guide (35), and the sliding block guide (35) comprises at least a first sliding block inclination (36) and comprises a further sliding block inclination (37).

9. The crimping die device according to claim 8, wherein the sliding block guide (35) is designed to open along at least one of the two sliding block inclinations (36, 37) at least in sections.

10. The crimping die device according to claim 8, wherein at least one of the two sliding block inclinations (36, 37) is designed to be substantially parallel to the contact surface (31; 131) of the wedge flange (30; 130) at least in sections.

11. The crimping die device according to claim 1, wherein a second guide device (25) is present, and the first movable pressing die (20; 120) is movable along the second guide device (25).

12. The crimping die device according to claim 1, wherein a pre-tensioning element (27), for pre-tensioning the first movable pressing die (20; 120), is present.

13. A crimping press (200) with a crimping die device (15; 115) according to claim 1, wherein a further pressing die (220) is present, and the further pressing die (220) is movable.

14. The crimping press according to claim 13, wherein the crimping press (200) and the crimping die device (15; 115) have a common base structure (17).

15. A method for creating a crimp connection to a crimping press according to claim 13, the method comprising the steps:

a) transferring the anvil, which is designed as a first movable pressing die, from a resting position into a crimping position;

b) positioning the wedge flange between the base structure and the first movable pressing die; and c) crimping the crimp connection with another pressing die, wherein at least one crimping tool is arranged on one of the two pressing dies.

16. The method according to claim 15, wherein, after step b), transferring the first movable pressing die in a direction of the resting position.

17. The method according to claim 15, wherein carrying out the transfer of the first movable pressing die and the positioning of the wedge flange simultaneously at step a) and b).

* * * * *